US010196181B2

(12) United States Patent
Strachan

(10) Patent No.: US 10,196,181 B2
(45) Date of Patent: Feb. 5, 2019

(54) CONTAINER CLOSURE

(71) Applicant: First Quality Packaging Solutions, LLC, Great Neck, NY (US)

(72) Inventor: Mark Strachan, Jupiter, FL (US)

(73) Assignee: First Quality Packaging Solutions, LLC, Chicago, IL (US)

( * ) Notice: Subject to any disclaimer, the term of this patent is extended or adjusted under 35 U.S.C. 154(b) by 35 days.

(21) Appl. No.: 15/061,751

(22) Filed: Mar. 4, 2016

(65) Prior Publication Data

US 2016/0257452 A1 Sep. 8, 2016

Related U.S. Application Data

(60) Provisional application No. 62/129,195, filed on Mar. 6, 2015.

(51) Int. Cl.
*B65D 43/02* (2006.01)
*B65D 21/02* (2006.01)

(52) U.S. Cl.
CPC ..... *B65D 43/0212* (2013.01); *B65D 21/0222* (2013.01); *B65D 2543/00027* (2013.01); *B65D 2543/0037* (2013.01); *B65D 2543/00092* (2013.01); *B65D 2543/00296* (2013.01); *B65D 2543/00407* (2013.01); *B65D 2543/00537* (2013.01); *B65D 2543/00546* (2013.01); *B65D 2543/00638* (2013.01); *B65D 2543/00685* (2013.01); *B65D 2543/00731* (2013.01); *B65D 2543/00814* (2013.01)

(58) Field of Classification Search
CPC ..... B65D 43/0212; B65D 21/0222; B65D 2543/00685; B65D 2543/00638; B65D 2543/00546; B65D 2543/00814; B65D 2543/00731; B65D 2543/0037; B65D 2543/00296; B65D 2543/00092; B65D 2543/00027; B65D 2543/00537; B65D 2543/00351
USPC ..... 220/380, 780–782, 709, 712, 713
See application file for complete search history.

(56) References Cited

U.S. PATENT DOCUMENTS 3,065,875 A 11/1962 Negoro
3,895,743 A * 7/1975 Christian ..... B65D 21/0219 206/508
3,931,890 A * 1/1976 Davis ..... B65D 43/0212 206/508
3,989,142 A * 11/1976 Gwilliam, Jr. ..... B65D 21/0219 206/508
4,076,123 A * 2/1978 Davis ..... B65D 43/0212 206/503
4,256,240 A 3/1981 Woinarski
4,275,815 A * 6/1981 Davis ..... B65D 21/0219 206/508
4,471,880 A 9/1984 Taylor et al.
4,953,743 A * 9/1990 Dart ..... B65D 43/0208 220/369

(Continued)

OTHER PUBLICATIONS

International Search Report for PCT/US2016/021021, dated May 17, 2016.

(Continued)

*Primary Examiner* — James N Smalley
(74) *Attorney, Agent, or Firm* — Amster, Rothstein & Ebenstein LLP

(57) ABSTRACT

An improved container closure is provided, and a manufacturing process therefor.

8 Claims, 6 Drawing Sheets

(56) References Cited

U.S. PATENT DOCUMENTS

| | | | | |
|---|---|---|---|---|
| 5,441,166 | A * | 8/1995 | Lucas, Jr. | B65D 43/0212 220/782 |
| 5,791,509 | A * | 8/1998 | Rush | B65D 43/0212 206/508 |
| 6,478,183 | B1 * | 11/2002 | Bacon | B65D 21/0219 206/508 |
| D766,086 | S | 9/2016 | Strachan | |
| D766,087 | S | 9/2016 | Strachan | |
| 2004/0206765 | A1 | 10/2004 | McMahon, III et al. | |
| 2006/0278634 | A1 * | 12/2006 | Wong | B65D 43/0212 220/4.21 |
| 2007/0039960 | A1 * | 2/2007 | Pawlik | B65D 51/18 220/254.7 |
| 2009/0178994 | A1 | 7/2009 | Smith et al. | |
| 2015/0021321 | A1 | 1/2015 | Gosen et al. | |

OTHER PUBLICATIONS

Written Opinion of the International Searching Authority for PCT/US2015/021021, dated May 17, 2016.

* cited by examiner

CONTAINER CLOSURE

BACKGROUND OF THE INVENTION

Existing portion cup lids, such as a standard 2 oz lid, are produced using the thermoforming process from a resin known as High Impact Polystyrene (HIPS) or Polyethylene Terephthalate (PET). There are certain disadvantages to these materials, and an improved product is desirable.

The present invention provides such a product, as well as a process of manufacture therefor.

SUMMARY OF THE INVENTION

This invention relates to a lid, preferably manufactured using polypropylene (PP) material, for an open-topped container, such as a portion cup, which has a high impact strength and a flexural modulus allowing for a tight seal (watertight) and retainability (stays on tub when tub is dropped) improved over conventional container closures for portion cups. A PRESS feature permits a consumer to apply pressure at the center of the lid with one finger causing it to snap onto the container with ease. The lid (container closure) can contain a ring structure permitting a matching tub to nest on top of the lid, to allow stacking. This is not evident on current 2 oz lids. A snap feature at the base of the portion cup and matching features in the lid permit the container to snap into a lid below it and thus be more secure when moved.

A container closure is provided for sealing against an outer surface of a rim of a container comprising:

a disk-shaped member including (i) a circumferential rim extending about a periphery, the circumferential rim of the disk-shaped member including an outer side annular wall extending around rim of the disk-shaped member, wherein the outer side annular wall has a top edge portion and a bottom edge portion flared outwards from the center, and (ii) a top wall connecting all parts of an upper surface of the top edge portion of the outer side annular wall, and being substantially perpendicular to the top edge portion of the outer side annular wall;

a plurality of indentations in the outer side annular wall at different circumferential positions of the outer wall but at the same vertical position of the outer wall, forming a plurality of ribs having a generally convex profile that protrude directly toward the center of the disk-shaped member;

and wherein the top wall has either a central circular horizontal portion or a central circular concave portion, either of which may be depressed by a user so as to push the plurality of indentations in the outer side annular wall of the disk shaped member down past an outer surface of a full bullnose-shaped rim of a container when centered on top of the container, so as to permit the container closure to seal against the outer surface of the full bullnose-shaped rim of a container, with an upper surface of the indentations of the plurality touching against the lower portion of the outer surface of a full bullnose-shaped rim when sealed;

and wherein the top wall comprises, between (a) the central circular horizontal portion or the central circular concave portion, and (b) a position where the top wall connects to the upper surface of the top edge portion of the outer side annular wall, a ring structure set into the top wall and sunken relative to both the central circular horizontal portion or central circular concave portion, and sunken relative to the positions where the top wall connects to the upper surface of the top edge portion of the outer side annular wall, wherein said ring structure comprises a plurality of radial spokes raised relative to the bottom portion of the ring structure, and flat horizontal portions in between each pair of adjacent radial spokes.

A manufacturing process for making the container closure as described herein is also provided.

DETAILED DESCRIPTION OF THE INVENTION

Figure 1:
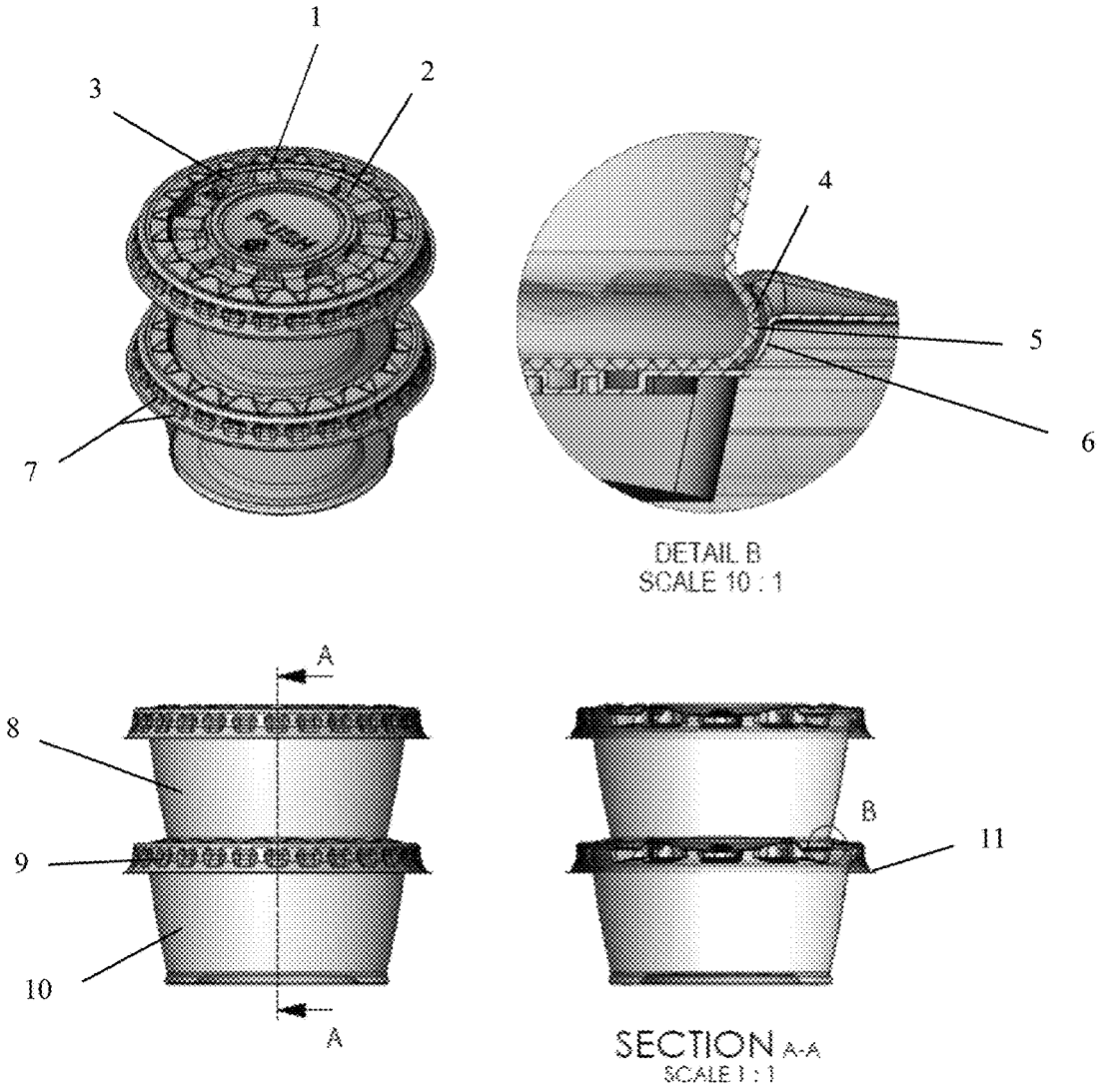
FIG. 1: Upper left panel of figure shows view of two stacked containers, each sealed with an embodiment of the container closures, showing raised spoke (1) in ring structure (3) as well as bottom portion of ring structure (2). The container closure on the bottom container shows a plurality of indentations in the outer side annular wall at different circumferential positions of the outer wall but at the same vertical position of the outer wall, forming a plurality of ribs having a generally convex profile (7). Lower left panel shows a side view of two stacked containers, each sealed with an embodiment of the container closures, with container one (10) topped by a container closure (9) and a second container (8) nesting on top of the container closure (9). The cross-section A-A, shown bottom right panel, also shows a bottom edge portion flared outwards (11) from the center the outer side of the annular wall of the container closure. The top right panel shows an embodiment whether the nesting mechanism by which an embodiment of the container closure can receive and engage the bottom of another container which comprises a convex annular rib (4) at the bottom thereof, with the apex of the convex rib (5) adjacent the concave portion of a ring structure (6).

This invention comprises container closures (or lids) for containers (e.g. open-topped tubs) such as 1 oz., 2 oz., 4 oz., and 6 oz. lid/tub configurations.

The present container closure, e.g. in the form of a lid, is preferably manufactured using polypropylene (PP) material. PP is considered to be a more sustainable material than HIPS or PET due to the fact that it has a better yield due to its rigidity. This also means that a thinner starting sheet thickness can be utilized with PP (as compared to HIPS or PET) to achieve a comparable lid to the HIPS or PET versions. PP also has higher impact strength and its flexural modulus allows for a tighter seal (such as a watertight seal. PP also exhibits good retainability (i.e. the container closure is more likely to stay on a tub sealed with the container closure when tub is dropped).

In an embodiment, the container closure also incorporates a "PUSH" feature, where the consumer is able to, with one finger, apply pressure at the center of the top surface of the container closure causing it to snap on the container (e.g. a tub) with ease. This makes it easier to handle and to effect a good closing seal for the consumer, especially if the consumer is elderly or has difficulty with their hands/fingers. Such portion cups, that the container closure can be used on in one embodiment, are often used in the homes for the elderly and are used for storage of medications. Accordingly, it is very helpful if the container closure (lid) can be removed and reapplied with ease. The "PUSH" feature assists in obtaining a good seal between the container closure and the container rim. In an embodiment, the seal obtained is watertight.

In an embodiment, the container closure (such as in the form of a 2 oz. portion cup lid) is designed such that a matching 2 oz. portion cup of the same design can nest on top of the container closure. This permits stacking of multiple containers, such as portion cups, which are sealed with the container closure(s). This is not evident on other 2 oz lids, for example. Such stacking can include an engaging feature such that the second container is locked on top of the first container's closure lid, but permits removal by the consumer pulling the second container off of the first container's closure lid. Such a feature can be particularly useful when a consumer fills the tubs with condiments and needs to carry multiple tubs at one time (e.g., ketchup, mustard, and mayonnaise). In an embodiment, the engaging feature is a snap feature at the base of the tub and matching features in the lid, so that the tub above can snap into the lid below it and thus be more secure when carrying condiments or medications. The snap feature can make an audible signal (e.g., from the polypropylene flexing) when the second container is pushed onto the container closure of the first container, such that the consumer is able to hear that the second container has been received and engaged by the container closure of the first (lower) container.

Provided is a container closure for sealing against an outer surface of a rim of a container comprising:

a disk shaped member including (i) a circumferential rim extending about a periphery, the circumferential rim of the disk shaped member including an outer side annular wall extending around rim of the disk shaped member, wherein the outer side annular wall has a top edge portion and a bottom edge portion flared outwards from the center, and (ii) a top wall connecting all parts of an upper surface of the top edge portion of the outer side annular wall, and being substantially perpendicular to the top edge portion of the outer side annular wall;

a plurality of indentations in the outer side annular wall at different circumferential positions of the outer wall but at the same vertical position of the outer wall, forming a plurality of ribs having a generally convex profile that protrude directly toward the center of the disk shaped member;

and wherein the top wall has either a central circular horizontal portion or a central circular concave portion, either of which may be depressed by a user so as to push the plurality of indentations in the outer side annular wall of the disk shaped member down past an outer surface of a rim of a container when centered on top of the container, so as to permit the container closure to seal against the outer surface of the rim of a container, with an upper surface of the indentations of the plurality touching against the lower portion of the outer surface of a rim when sealed;

and wherein the top wall comprises, between (a) the central circular horizontal portion or the central circular concave portion, and (b) where the top wall connects to the upper surface of the top edge portion of the outer side annular wall, a ring structure set into the top wall and sunken relative to both the central circular horizontal portion or central circular concave portion, and sunken relative to the positions where the top wall connects to the upper surface of the top edge portion of the outer side annular wall, wherein said ring structure comprises a plurality of radial spokes raised relative to the bottom portion of the ring structure and flat horizontal portions in between each pair of adjacent radial spokes.

In an embodiment, the rim is a bullnose-shaped rim.

In an embodiment, the container closure comprises polypropylene. In an embodiment, the entire container closure is formed as a single piece of polypropylene. In an embodiment, the container closure does not comprise High Impact Polystyrene (HIPS) or Polyethylene Terephthalate (PET).

In an embodiment, the container closure comprises the central circular concave portion. In a preferred embodiment, the concave portion is a concave disc. In an embodiment, "concave" as used in regard to the central circular concave portion means the apex of the curve of the concave disc is lower than the periphery of the concave disc when the container closure is placed in an upright position.

In an embodiment, the container closure comprises the central circular horizontal portion.

In an embodiment, the raised spokes, when seen from above, are largely rectangular in nature, with the long sides of the rectangle positioned so as to substantially radiating out from the center of the disk towards the circumferential rim extending about the periphery of the container closure. In an embodiment, the inner end of the raised spoke is shorter than the outer end of the raised spoke.

In an embodiment, the container has a bottom which has an inner annular wall of a first diameter, an outer annular wall of a second diameter larger than the first diameter, and a bottom wall which connects a bottom edge of the inner annular wall and the bottom edge of the outer annular wall, and which bottom wall is largely horizontally disposed when the container is placed in an upright position.

In an embodiment, the ring structure has an inner diameter and an outer diameter which are larger than, respectively, the first diameter and the second diameter, such that a container can nest on top of the container closure with portions of its bottom wall resting atop the plurality of radial spokes raised relative to the bottom portion of the ring structure.

In an embodiment, the container closure is sealed against an outer surface of a rim of a first container. In an embodiment, the rim is a bullnose-shaped rim. In an embodiment, a second container nested on top of the container closure with portions of the second container's bottom wall resting atop the plurality of radial spokes raised relative to the bottom portion of the ring structure.

In an embodiment, the container has a bottom which has (x) an inner annular wall of a first diameter, (y) an outer annular wall of a second diameter larger than the first diameter, and a (z) first bottom wall which connects a bottom edge of the inner annular wall and the bottom edge of the outer annular wall, and which bottom wall is largely disposed at an acute angle of less than 25° relative to a horizontal plane of the container when the container is placed in an upright position on a flat horizontal surface. In an embodiment, the bottom portion of the outer annular wall comprises a convex annular rib around its outer circumference, with the apex of the convex rib having a wider diameter than the bottom edge of the outer annular wall, and wherein the bottom of the container has a second bottom wall which is largely disposed horizontally when the container is in an upright position and which second bottom wall is continuous with the top edge of the inner annular wall of a first diameter so as to form a continuous bottom for the container with (x), (y) and (z). In an embodiment, the convex annular rib of the bottom portion of the outer annular wall is parallel to the double bullnose-shaped rim of the container at the top of the container.

In an embodiment, the portion of the top wall of the container closure connecting the bottom of the indented ring structure to the upper surface of the top edge portion of the outer side annular wall is concave, permitting receiving and engaging of the lower portion of a second container of the same design as the first container via engaging the convex annular rib of the bottom portion of the outer annular wall of the second container with the concave portion of the ring structure of the container closure.

In an embodiment, a plurality of portions of the second container's bottom wall resting atop the plurality of radial spokes raised relative to the bottom portion of the ring structure.

In an embodiment, the central circular horizontal portion of the top wall or the central circular concave portion of the top wall has the text: PUSH embossed thereon. In an embodiment, the central circular horizontal portion of the top wall or the central circular concave portion of the top wall has a non-English language equivalent of PUSH embossed thereon.

In an embodiment, the container is a 2 oz. container. In an embodiment, the container is a 1 oz., 4 oz., or 6 oz. container.

In an embodiment, the central circular horizontal portion of the top wall, when pressed, stays in a depressed position, without any further pressure being applied by the consumer, relative to the its position before being pressed.

In an embodiment, the container is made from HIPS or PET. In an embodiment, the container is made from polypropylene. In an embodiment, the polypropylene is isotactic. In an embodiment, the polypropylene is syndiotactic.

Also provided is a process for manufacturing the container closure as described herein, comprising molding a polypropylene material to the shape of the container closure.

In an embodiment, the polypropylene material is injection molded into the shape of the container closure. In an embodiment, the polypropylene material is blow molded or is injection-stretch blow molded into the shape of the container closure.

The bullnose-shaped rim is a descriptive term regarding the cross-sectional shape of the rim. In different embodiments the bullnose shaped rim is "half" bullnose-shaped (i.e. with an arc only the top of the rim, such as a 90° arc) or can be "full" bullnose-shaped (i.e. with an arc on the top and the bottom of the rim, such as a 180° arc). A "full" bullnose-shaped rim is shown (35) in FIG. 3. In an alternative embodiment, the bullnose shaped rim is between a 90° arc and a 180° arc. In an embodiment, the rim can curve back under the edge, and be in excess of a 180° arc.

In an embodiment, the container closure is as shown in any one of FIGS. 1-6.

Examples

One example of the container closure, and associated container is shown in FIG. 1, where the upper left panel of the figure shows view of two stacked containers, each sealed with an embodiment of the container closures, showing raised spoke (1) in ring structure (3) as well as bottom portion of ring structure (2). Container closure on bottom container shows a plurality of indentations in the outer side annular wall at different circumferential positions of the outer wall but at the same vertical position of the outer wall, forming a plurality of ribs having a generally convex profile (7). Lower left panel shows side view of two stacked containers, each sealed with an embodiment of the container closures, with container one (10) topped by a container closure (9) and a second container (8) nesting on top of the container closure (9). The cross-section A-A, shown bottom right panel, also shows a bottom edge portion flared outwards (11) from the center the outer side of the annular wall of the container closure. The top right panel shows an embodiment whether the nesting mechanism by which an embodiment of the container closure can receive and engage the bottom of another container which comprises a convex annular rib (4) at the bottom thereof, with the apex of the convex rib (5) in juxtaposed the concave portion of a ring structure (6).

Figure 2:
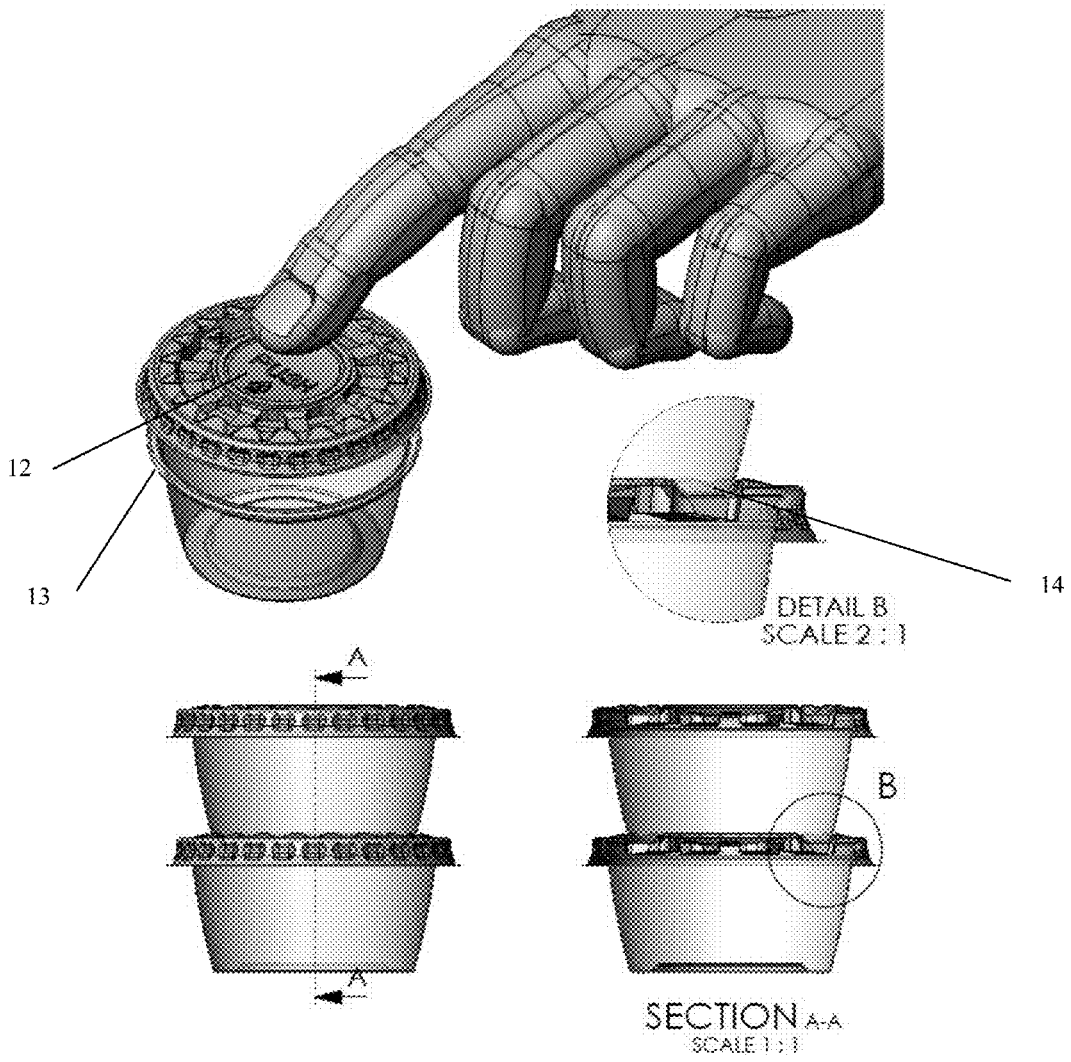
FIG. 2: Top left panel shows exemplary container closure with central circular horizontal or concave portion (12) which can be depressed by user to seal container closure onto container wherein the plurality of ribs having a generally convex profile contact with a bullnose shaped rim (13) of the container. In an embodiment, when the container closure is pressed onto the container top the upper surface of the plurality of ribs having a generally convex profile are in contact with, and press against, the bullnose-shaped rim and form a seal. Lower left panel shows two containers, both with container closures, with one stacked upon the other and with the bottom of the second container nesting in the ring structure of the container closure of the first (lower) container. The lower right panel shows cross-section A-A, and the upper right panel shows detail B where the second container is nested on top of the container closure of the first container with portions of the second container's bottom wall resting atop the plurality of radial spokes raised relative to the bottom portion of the ring structure. In this embodiment shown, the second container's bottom wall (14) does not comprise a convex annular rib (4) at the bottom as shown in FIG. 1 and the ring structure of the container closure does not comprise the concave portion (6) as shown in FIG. 1.

A further example of the container closure, and associated container is shown in FIG. 2, where the top left panel shows exemplary container closure with central circular horizontal portion (12) which can be depressed by user to seal container closure onto container wherein the plurality of ribs having a generally convex profile contact with bullnose shaped rim (13) of the container. In an embodiment the upper surface of the plurality of ribs having a generally convex profile, when the container closure is pressed onto the container top, contact with bullnose-shaped rim and form a seal by the upper surface of the plurality of ribs having a generally convex profile are in contact and press against at least portions of the lower surface of the bullnose-shaped rim. Lower left panel shows two containers, both with container closures, with one stacked upon the other and with the bottom of the second container nesting in the ring structure of the container closure of the first glower) container. The lower right panel shows cross-section A-A, and the upper right panel shows detail B where the second container is nested on top of the container closure of the first container with portions of the second container's bottom wall resting atop the plurality of radial spokes raised relative to the bottom portion of the ring structure. In this embodiment, the second container's bottom wall (14) does not comprise a convex annular rib (4) at the bottom as shown in FIG. 1 and the ring structure of the container closure does not comprise the concave portion (6) as shown in FIG. 1.

Figure 3:
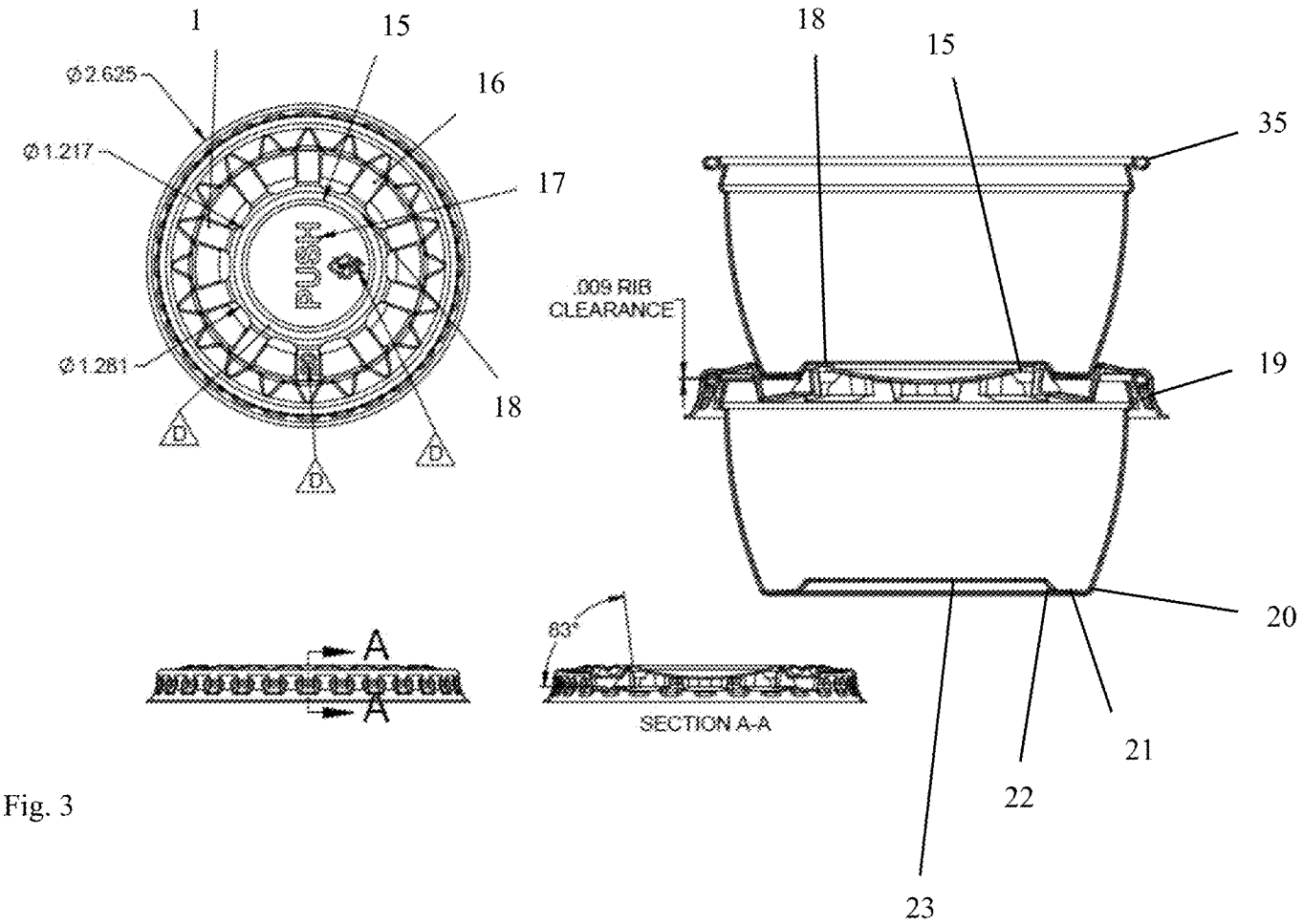
FIG. 3: The top left panel shows top view of an embodiment of the container closure. A plurality of raised spoke structures are visible including the examples of raised spokes (1) and (16) within the ring structure. The "PUSH" text (17) embodiment is seen on the central horizontal circular portion. In an embodiment, a first flat ring portion (15) of the top wall can remain disposed horizontally when the central circular horizontal portion (see (12) in FIG. 2) is depressed. See also FIG. 4, where a depressed central circular concave portion (32) (i.e. with the apex of the curve lower than the periphery of the curve when the container closure is placed in an upright position) is shown in cross-section. In an embodiment, a second flat ring portion (18) of the top wall is raised relative to (15) and (17). As shown in the bottom panel, an inner wall of the ring structure is less than perpendicular with regard to a horizontal plane of the container closure. In a non-limiting example it is at 83° thereto. (See also FIG. 4 showing an inner wall (33) of the ring structure and an outer wall of the ring structure (34)). A bullnose-shaped rim (35) is shown (full bullnose shaped in the example shown).

As in the top left panel of FIG. 3, a top view of an embodiment of the container closure shows a plurality of raised spoke structures are visible including the examples of raised spokes (1) and (16) within the ring structure. The "PUSH" text (17) embodiment is seen on the central horizontal circular portion. This aids the "Press" function described hereinabove. In an embodiment, a first flat ring portion (15) of the top wall can remain disposed horizontally when the central circular horizontal portion (see (12) in FIG. 2) is depressed. See also FIG. 4, where a depressed central circular concave portion (32) (i.e. with the apex of the curve lower than the periphery of the curve when the container closure is placed in an upright position) is shown in cross-section. In an embodiment, a second flat ring portion (18) of the top wall is raised relative to (15) and (17). As shown in the bottom panel, an inner wall of the ring structure can is less than perpendicular with regard to a horizontal plane of the container closure, in a non-limiting example at 83° thereto. (See also FIG. 4 showing an inner wall (33) of the ring structure and an outer wall of the ring structure (34)).

Figure 4:
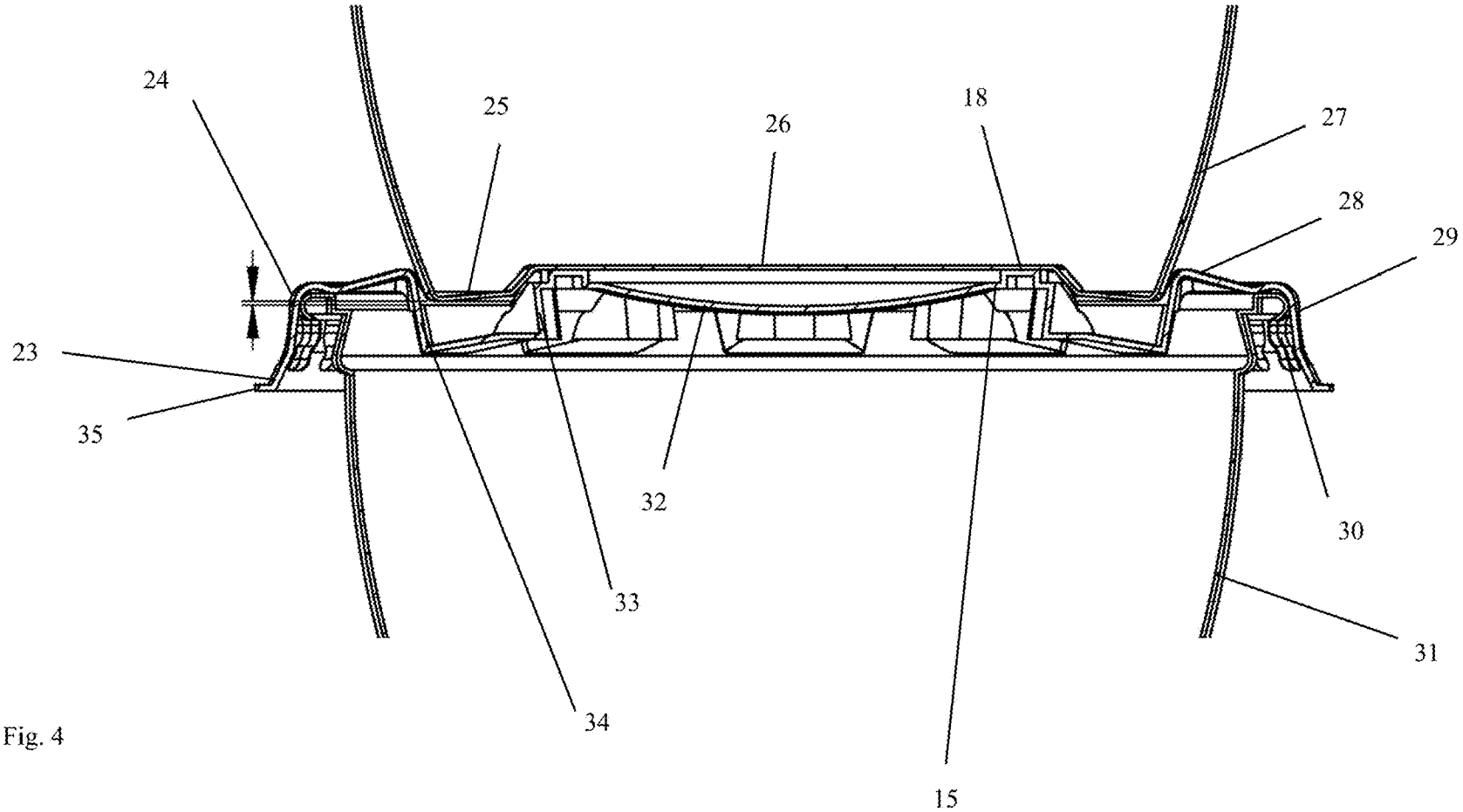
FIG. 4: cross-section of a portion of a first container (upper portion shown (31)) sealed with an embodiment of the container closure, on top of which is nested a second container (lower portion shown (27)). The outer side annular wall (29) of the container closure has a top edge portion (24) and a bottom edge portion (23) flared outwards from the center. The bottom edge portion in this example further comprises an additional horizontal ring (35) at the bottom thereof. In the top wall, the ring structure of the container closure comprises an inner wall (33) and an outer wall of the ring structure (34)). The top wall in this embodiment further comprises a first flat ring portion (15) of the top wall disposed horizontally and a second flat ring portion (18) of the top wall raised relative to (15). Depressed central circular concave portion (32) is shown in cross-section. A single rib (30) of the plurality of ribs having a generally convex profile is also shown, abutting on its uppermost surface a bullnose-shaped rim of the first container. Also shown, in regard to the second container, is a container bottom which has an inner annular wall of a first diameter, an outer annular wall of a second diameter larger than the first diameter, and a first bottom wall (25) which connects a bottom edge of the inner annular wall and the bottom edge of the outer annular wall, and which first bottom wall is largely disposed at an acute angle of less than 25° relative to a horizontal plane of the container when the container is placed in an upright position on a flat horizontal surface. The outer annular wall of a second diameter larger than the first diameter, which joins to (26) can also be at an acute angle relative to the same reference positions, but at a larger acute angle than (25), as shown in the example in FIG. 4. Also shown is a second bottom wall (26) which is largely disposed horizontally when the container is in an upright position and which second bottom wall is continuous with the top edge of the inner annular wall of a first diameter which is continuous with (25), which in turn is continuous with an outside wall of the second container.

A close-up cross-section of a portion of a first container (upper portion shown (31)) sealed with an embodiment of the container closure is shown in FIG. 4, on top of which is nested a second container (lower portion shown (27)). The outer side annular wall (29) of the container closure has a top edge portion (24) and a bottom edge portion (23) flared outwards from the center. The bottom edge portion in this example further comprises an additional horizontal ring (35) at the bottom thereof. In the top wall, the ring structure of the container closure comprises an inner wall (33) and an outer wall of the ring structure (34)). The top wall in this embodiment further comprises a first flat ring portion (15) of the top wall disposed horizontally and a second flat ring portion (18) of the top wall raised relative to (15). Depressed central circular concave portion (32) is shown in cross-section. A single rib (30) of the plurality of ribs having a generally convex profile is also shown, abutting on its uppermost surface a bullnose-shaped rim of the first container. Also shown, in regard to the second container, is a bottom which has an inner annular wall of a first diameter, an outer annular wall of a second diameter larger than the first diameter, and a first bottom wall (25) which connects a bottom edge of the inner annular wall and the bottom edge of the outer annular wall, and which first bottom wall is largely disposed at an acute angle of less than 25° relative to a horizontal plane of the container when the container is placed in an upright position on a flat horizontal surface. The outer annular wall of a second diameter larger than the first diameter, which joins to (26) can also be at an acute angle relative to the same reference positions, but at a larger acute angle than (25), as shown in the example in FIG. 4. Also shown is a second bottom wall (26) which is largely disposed horizontally when the container is in an upright position and which second bottom wall is continuous with the top edge of the inner annular wall of a first diameter which is continuous with (25), which in turn is continuous with an outside wall of the second container.

Figure 5:
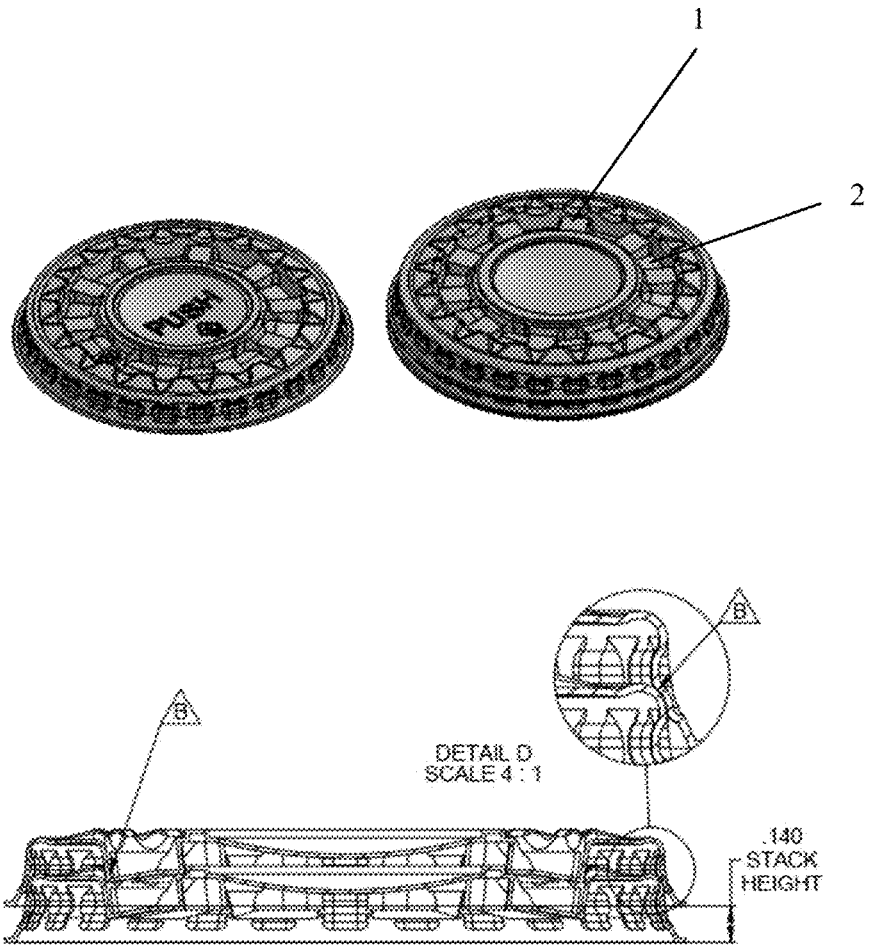
FIG. 5: Upper panel of figure shows two embodiments of the container closure, showing raised spoke (1) and bottom of ring structure (2). Lower panel shows an example of a stacked pair of container closures. One container closure stacks on top of a second container closure, but without the ribs engaging underneath the top portion of the outer side annular wall (29) of the container closure such that the container closures are readily separable by a user.

The stackable nature of the container closures themselves (i.e. when not sealed onto a container) is shown in FIG. 5, where the upper panel of the figure shows two embodiments of the container closure, showing raised spoke (1) and bottom of ring structure (2). and the lower panel shows an example of a stacked pair of container closures. One container closure stacks on top of a second container closure, but without the ribs engaging underneath the top portion of the outer side annular wall (29) of the container closure such that the container closures are readily separable by a user.

Figure 6:
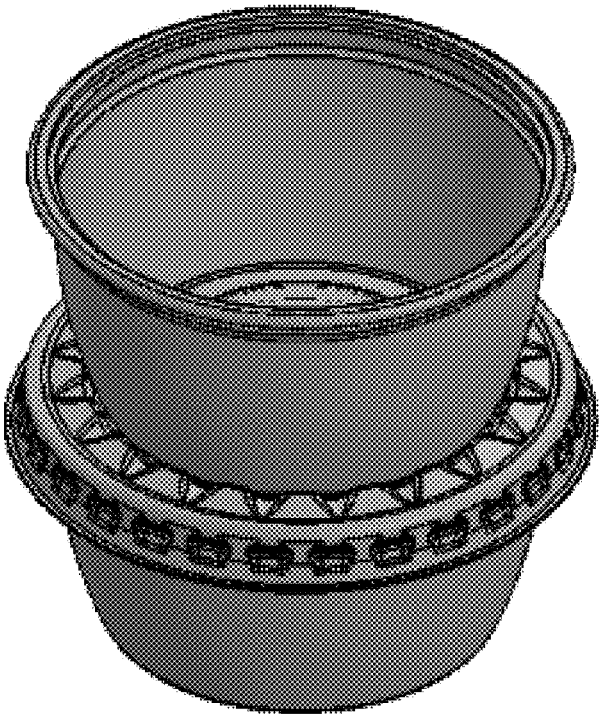
FIG. 6: Figure showing a first container with a container closure sealed thereon and a second container (with no container closure) nesting in the ring structure of the container closure of the first container.

FIG. 6 shows an embodiment wherein a first container with a container closure sealed there onto and a second container (with no container closure) nesting in the ring structure of the container closure of the first container.

The invention claimed is:

1. A container closure for sealing against an outer surface of a rim of a container comprising:

a substantially disk shaped member formed as a solid piece with no openings and comprising:

a top wall;

a circumferential rim extending about a periphery of the top wall, the circumferential rim including an outer side annular wall, wherein the outer side annular wall has a top edge portion and a bottom edge portion flared outwards from the top edge portion; and a plurality of indentations in the outer side annular wall at different circumferential positions of the outer wall and at a same vertical position of the outer wall, forming a plurality of ribs each having a generally curved profile protruding convex profile that protrude directly toward a center of the substantially disk shaped member;

the top wall comprising:

a central circular horizontal portion or a central circular concave portion that is depressible by a user so as to push the plurality of indentations in the outer side annular wall of the substantially disk shaped member down past an outer surface of a rim of a container when the container closure is centered on top of the container and so that the container closure seals against the outer surface of the rim of the container, with an upper surface of the plurality of indentations touching against the lower portion of the outer surface of the rim when sealed; and a ring structure disposed between (a) the central circular horizontal portion or the central circular concave portion, and (b) the periphery of the top wall, the ring structure set into the top wall and sunken relative to both the central circular horizontal portion or central circular concave portion, and sunken relative to the periphery of the top wall, the ring structure comprising:

a plurality of radial spokes raised relative to a bottom portion of the ring structure, the bottom portion of the ring structure comprising flat horizontal portions in between each pair of adjacent radial spokes.

2. The container closure of claim 1, wherein the container closure comprises polypropylene.

3. The container closure of claim 1, wherein the entire container closure is formed as a single piece of polypropylene.

4. The container closure of claim 1, wherein the container closure does not comprise High Impact Polystyrene (HIPS) or Polyethylene Terephthalate (PET).

5. The container closure of claim 1, wherein the container closure comprises a central circular concave portion.

6. The container closure of claim 1, wherein the concave portion is a concave disc.

7. The container closure of claim 1, wherein the container closure comprises a central circular horizontal portion.

8. The container closure of claim 1, wherein the plurality of radial spokes are rectangular shaped.

* * * * *